US009999965B2

(12) United States Patent
Shyu

(10) Patent No.: US 9,999,965 B2
(45) Date of Patent: Jun. 19, 2018

(54) DETACHABLE AND TORQUE ADJUSTABLE CROSS WRENCH

(71) Applicant: Jun-Tsai Shyu, Taichung (TW)

(72) Inventor: Jun-Tsai Shyu, Taichung (TW)

( * ) Notice: Subject to any disclaimer, the term of this patent is extended or adjusted under 35 U.S.C. 154(b) by 446 days.

(21) Appl. No.: 14/946,766

(22) Filed: Nov. 19, 2015

(65) Prior Publication Data

US 2017/0144280 A1 May 25, 2017

(51) Int. Cl.

| | |
|---|---|
| ***B25B 23/142*** | (2006.01) |
| ***B25B 13/00*** | (2006.01) |
| ***B25G 1/00*** | (2006.01) |

(52) U.S. Cl.

CPC ..... *B25B 23/1427* (2013.01); *B25B 13/005* (2013.01); *B25G 1/005* (2013.01)

(58) Field of Classification Search

CPC . B25B 13/005; B25B 23/1427; B25B 23/141; B25G 1/005

See application file for complete search history.

(56) References Cited

U.S. PATENT DOCUMENTS

| | | | | |
|---|---|---|---|---|
| 7,082,863 | B1 * | 8/2006 | Wang | B25B 23/0035 81/177.5 |
| 7,228,766 | B1 * | 6/2007 | Shyu | B25B 13/005 81/125.1 |
| 8,960,058 | B2 * | 2/2015 | Lai | B25B 23/1427 81/467 |
| 9,032,848 | B2 * | 5/2015 | Hsieh | B25B 23/142 81/483 |
| 9,149,918 | B2 * | 10/2015 | Lee | B25B 23/1427 |
| 2014/0007699 | A1 * | 1/2014 | Mountz | B25B 23/1427 73/862.21 |

* cited by examiner

*Primary Examiner* — David B Thomas

(57) ABSTRACT

A detachable and torque-adjustable cross wrench includes a primary bar and a torque-setting secondary bar, and an end of the primary bar is a socket insertion end and the other end of the primary bar is installed with an assistant turning handle provided for pivoting. A penetrating hole formed at a thickening middle section is provided for connecting the torque-setting secondary bar to form a cross wrench. The torque-setting secondary bar includes a plugging inner rod with a spacer ring slot, a force applying outer rod containing a torque-setting module, a handheld turning handle, an elastic pushing member, a torque-adjusting screw cap and a retaining ring. The torque-adjusting screw cap is provided for rotating and adjusting the torque-setting module to a predetermined torque value, so as to achieve an expected torque-setting.

3 Claims, 7 Drawing Sheets

DETACHABLE AND TORQUE ADJUSTABLE CROSS WRENCH

BACKGROUND OF THE INVENTION (a) Field of the Invention

The present invention relates to a detachable cross wrench structure whose torque value can be adjusted, more particularly to a simple, easy and practical wrench capable of achieving the synergic effect of a quick rotation and a simple torque setting of the wrench through simple and easy insertion and setting adjustment.

(b) Description of the Related Art

With reference to U.S. Pat. No. 7,228,766 entitled "Detachable cross wrench" and issued to the inventor of the present invention, the detachable cross wrench refers to a specific wrench that can be disassembled for storage and quickly assembled for use, and such wrench is very suitable to be packaged, stored and used quickly while providing the effect of applying force easily to accelerate and assist the rotation of the wrench, so that such wrench is welcome by users. However, the inventor discovered later that professional users requiring a setting of the torque have to change to a torque adjusting wrench to prevent damages to a screw while applying too much force to secure the screw. It shows that such patented technology still has a minor shortcoming on performance.

As well known, the so-called torque adjusting wrench (not shown in the figure) refers to a wrench with a design of having an operating end and a force applying end engaged with each other, and a powerful elastic element for providing a strong friction between related component modules, so that when the force applied to the wrench reaches a predetermined value, a setback occurs at the engaging portion of the operating end and the force applying end, and users may know about the situation immediately and stop applying force to prevent damages to the wrench by excessive force.

From related literatures, we learn that all conventional torque adjusting wrenches are primarily designed with a F-shaped handle and most of them doe not come with a cross-shaped design, so that the wrench cannot be rotated quickly to shorten the operating time effectively and improve the operating efficiency, unless users carry both cross wrench and torque adjusting wrench all the time and use them alternately, and the operation by using both wrenches alternately brings tremendous inconvenience to users. Obviously, the conventional wrench requires improvements.

SUMMARY OF THE INVENTION

Therefore, it is a primary objective of the present invention to provide a detachable cross wrench set as a prototype, and the secondary bar is changed to a specific structure whose torque can be set by users, and the technical characteristics of both detachable cross wrench and torque adjusting wrench are combined into the detachable and torque-adjustable cross wrench.

According to the invention, a detachable and torque-adjustable cross wrench includes a primary bar and a torque-setting secondary bar, and an end of the primary bar is a socket insertion end and the other end of the primary bar is installed with an assistant turning handle provided for pivoting. A penetrating hole formed at a thickening middle section is provided for connecting the torque-setting secondary bar to form a cross wrench. The torque-setting secondary bar includes a plugging inner rod with a spacer ring slot, a force applying outer rod containing a torque-setting module, a handheld turning handle, an elastic pushing member, a torque-adjusting screw cap and a retaining ring. The torque-adjusting screw cap is provided for rotating and adjusting the torque-setting module to a predetermined torque value, so as to achieve an expected torque-setting.

DETAILED DESCRIPTION OF THE PREFERRED EMBODIMENT

The technical measures and characteristics of the present invention will become clearer in light of the following detailed description of an illustrative embodiment of this invention described in connection with the drawings.

With reference to FIGS. 1 to 4 for a detachable and torque-adjustable cross wrench in accordance with a preferred embodiment of the present invention, the detachable and torque-adjustable cross wrench comprises a primary bar 10, and a torque-setting secondary bar 20.

Figure 1:
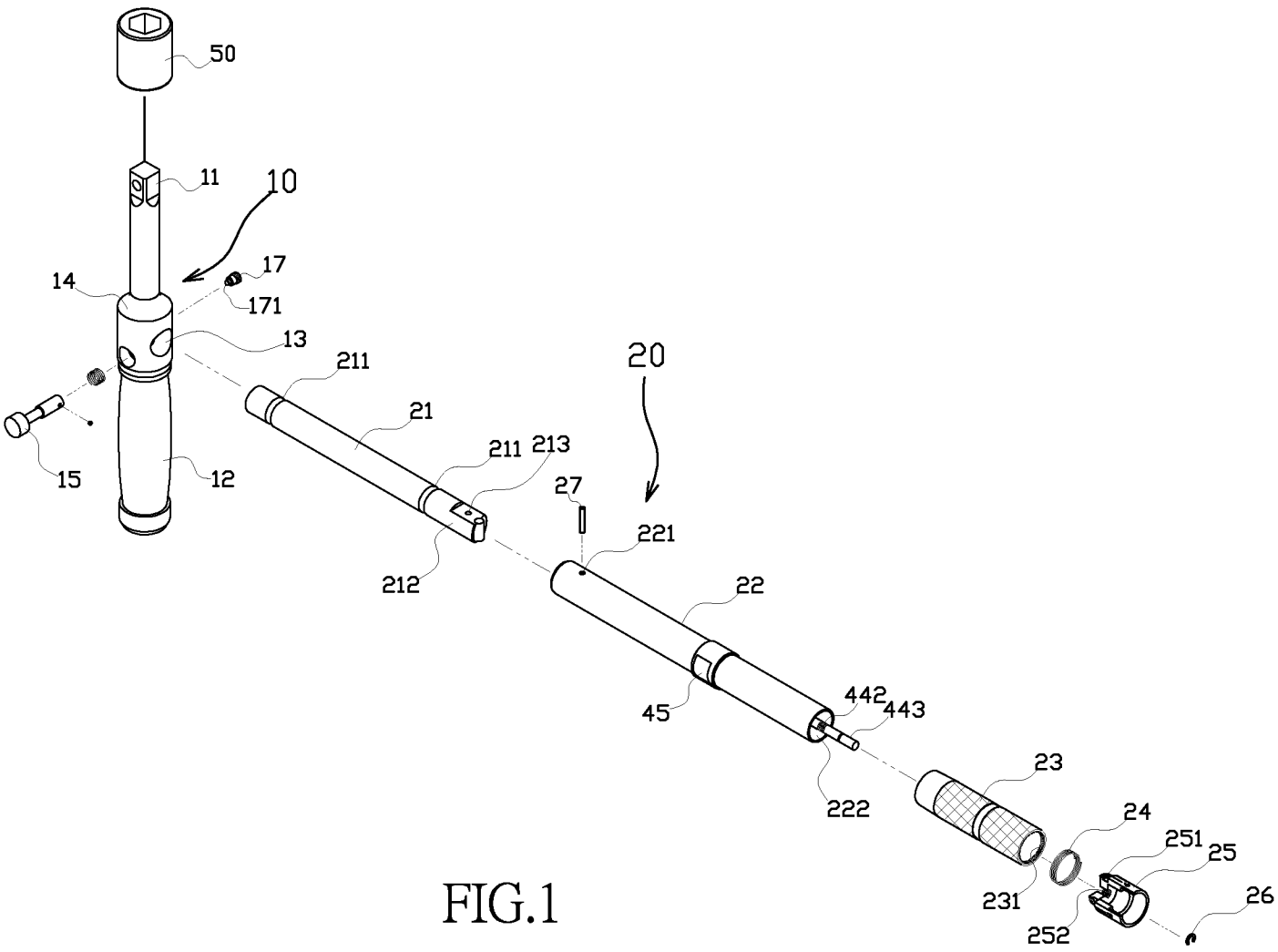
FIG. 1 is an exploded view of a preferred embodiment of the present invention.
Figure 2:
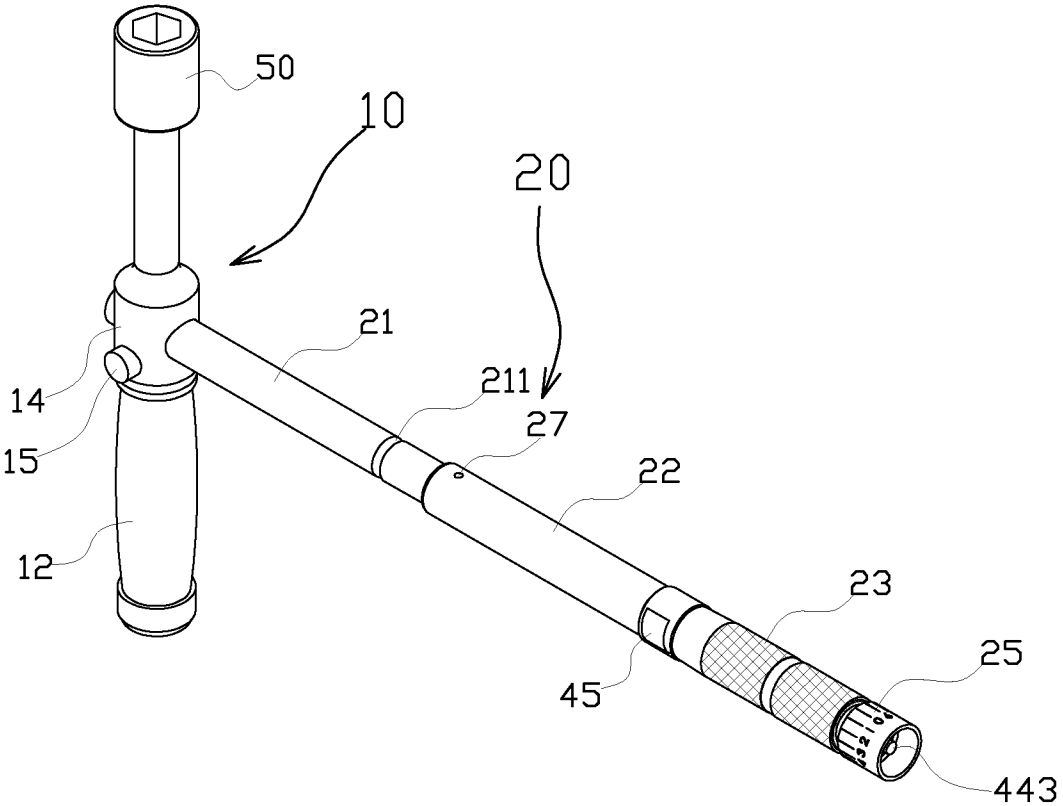
FIG. 2 is a perspective view of the preferred embodiment as depicted in FIG. 1.
Figure 3:
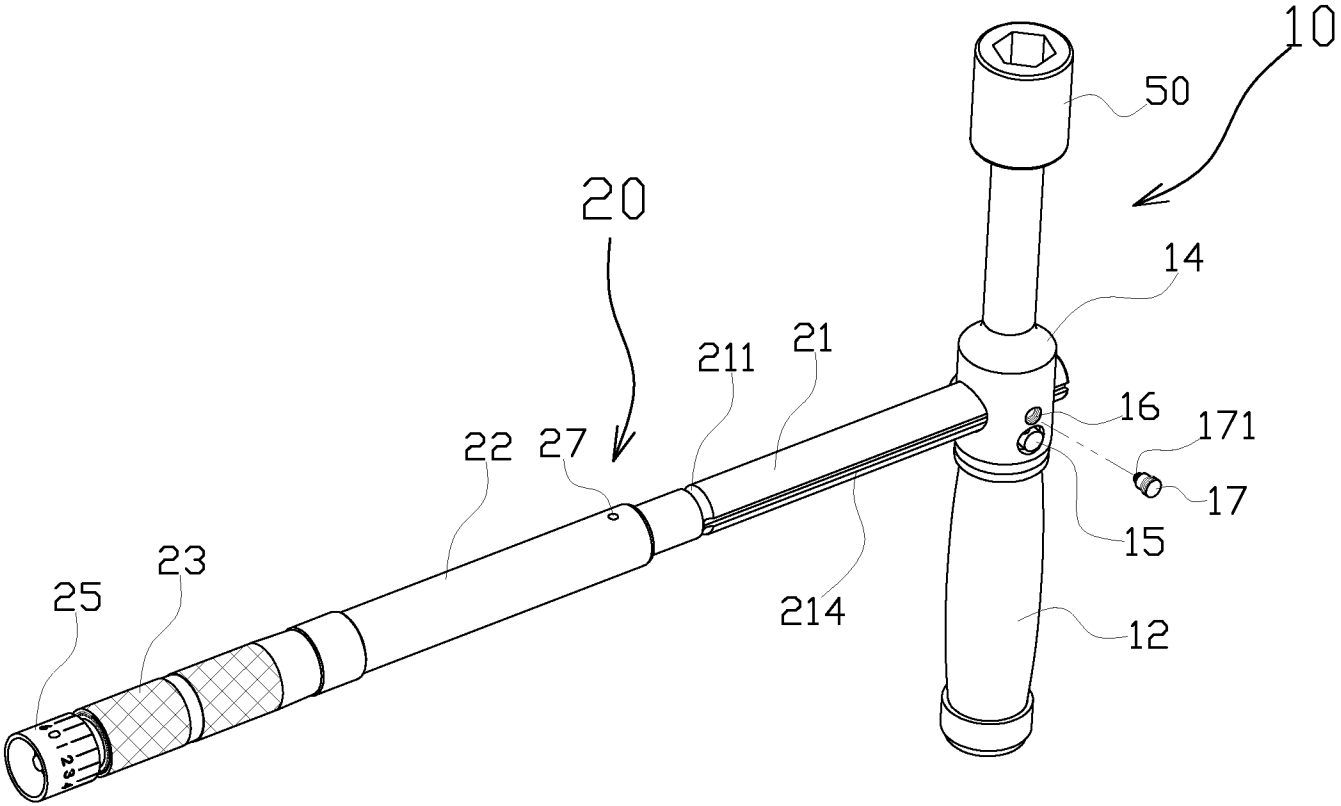
FIG. 3 is a partially exploded view of the preferred embodiment as depicted in FIG. 1 viewing from another direction.
Figure 4:
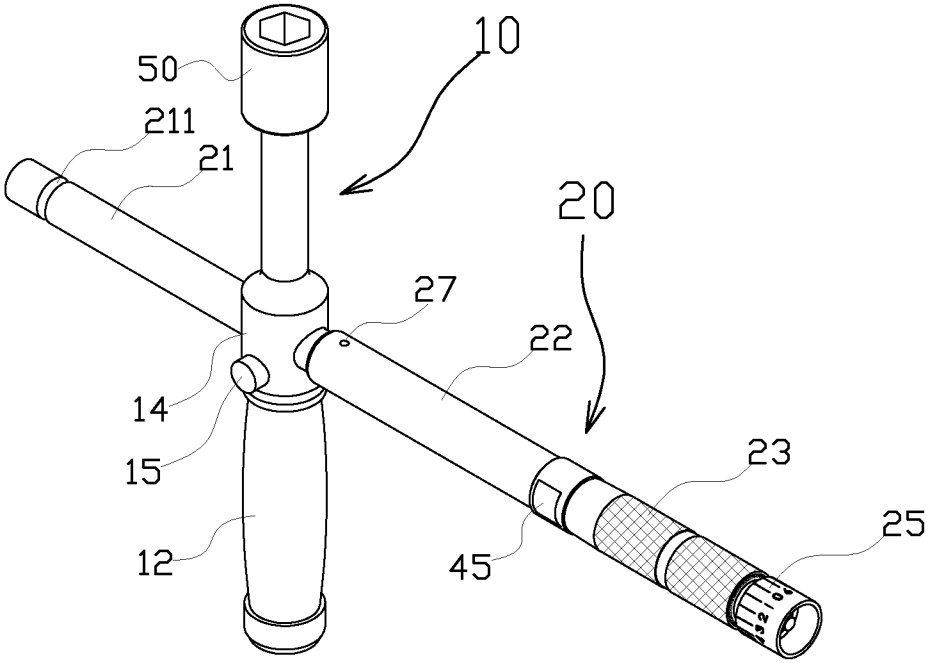
FIG. 4 is another perspective view of the preferred embodiment as depicted in FIG. 1.

The primary bar 10 has an end which is a socket insertion end 11 provided for inserting a socket 50 and screwing a screw (not shown in the figure) and the other end installed with an assistant turning handle 12 provided for a screwing operation. In addition, the center portion of the primary bar 10 has a thickening middle section 14 with a penetrating hole 13, and a compression knob 15 installed adjacent to the penetrating hole 13 for providing a latching effect and operated in cooperation with a ring slot 211 of a plugging inner rod 21 of the torque-setting secondary bar 20 to provide the latching and releasing effects. In addition, an inner threaded hole 16 is formed at the bottom of the thickening middle section 14, such that when a positioning bold 17 is secured, and a front edge 171 of the positioning bold 17 is slightly extended into the penetrating hole 13 to give a positioning effect with a positioning slot 214 formed at a corresponsive position of the plugging inner rod 21 (as shown in FIG. 3).

The torque-setting secondary bar 20 comprises a plugging inner rod 21 with a spacer ring slot 211, a force applying outer rod 22 having a torque-setting module 40 installed therein, a handheld turning handle 23, an elastic pushing member 24, a torque-adjusting screw cap 25 and a retaining ring 26, wherein a pivoting end 212 of the plugging inner rod 21 has a pin hole 213, and an insert pin 27 and a corresponsive pin hole 221 of the force applying outer rod 22 are provided for insertion and pivotal connection, so that the torque-setting module 40 can be adjusted to a predetermined torque value by the torque-adjusting screw cap 25 to achieve an expected torque-setting.

Figure 5:
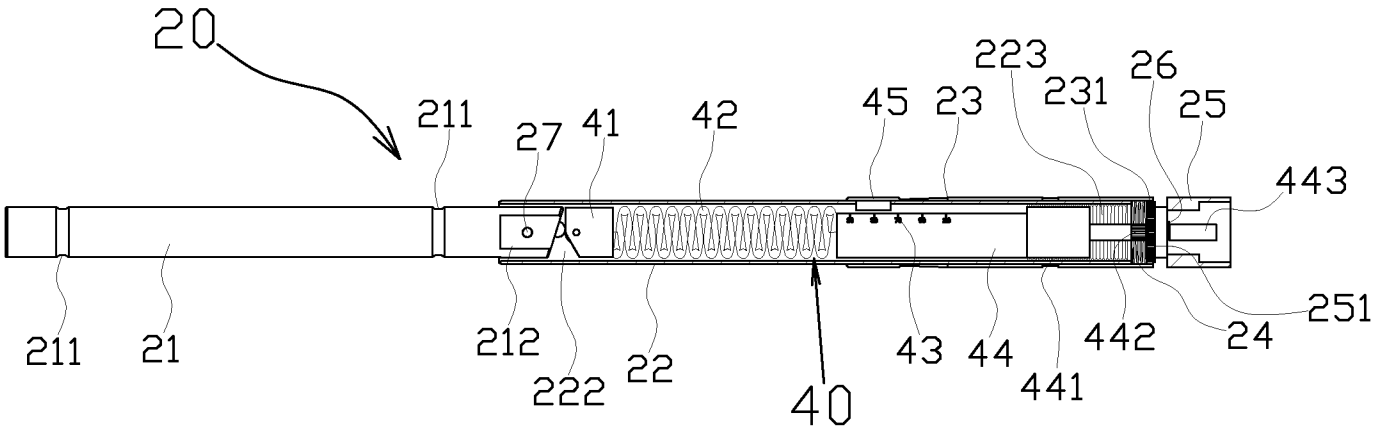
FIG. 5 is a perspective and partially sectional view of a torque-setting secondary bar in accordance with a preferred embodiment of the present invention.

With reference to FIG. 5 as well, the torque-setting module 40 is concealed in an axial inner hole 222 of the force applying outer rod 22 and sequentially includes an ejecting block 41 contacted with the pivoting end 212 of the plugging inner rod 21, a powerful ejecting member 42, a sliding block 44 having a scale 43, and a window 45 installed at the outer periphery of the force applying outer rod 22 for viewing a calibration of the scale 43, wherein an external threaded portion 441 of the sliding block 44 is screwed and engaged with an internal threaded portion 223 of the force applying outer rod 22, and an open end of the sliding block 44 has a torque-adjusting column 443 for driving a ratchet 442, so that when the sliding block 44 is driven and pressed further at the powerful ejecting member 42, the torque value becomes greater (or the friction between the ejecting block 41 and the pivoting end 212 of the plugging inner rod 21 becomes greater), and vice versa.

Figure 6:
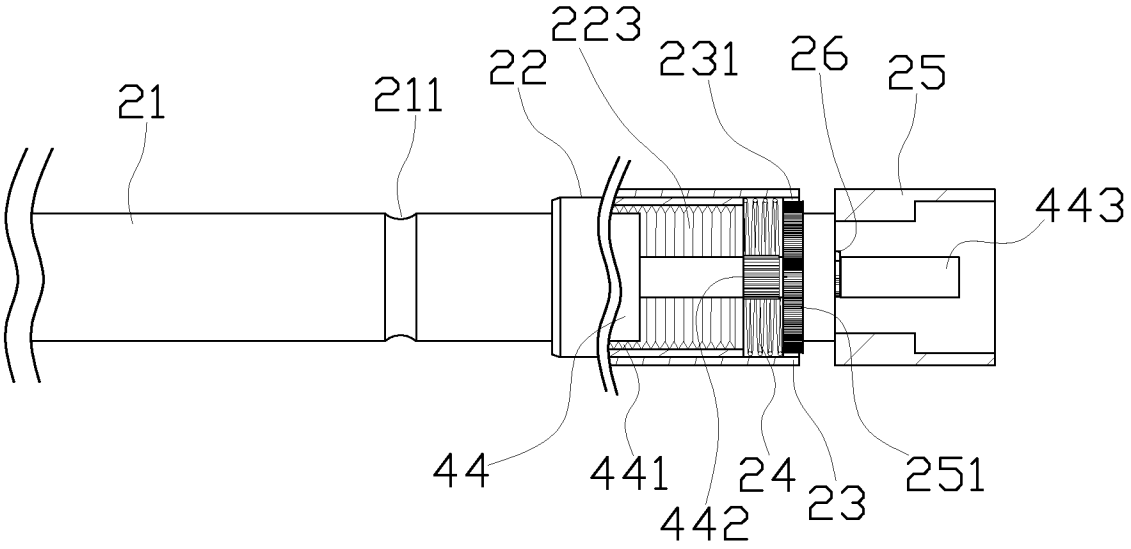
FIG. 6 is a perspective and partially sectional blowup view of the torque-setting secondary bar as depicted in FIG. 5 and situated at a normal position.
Figure 7:
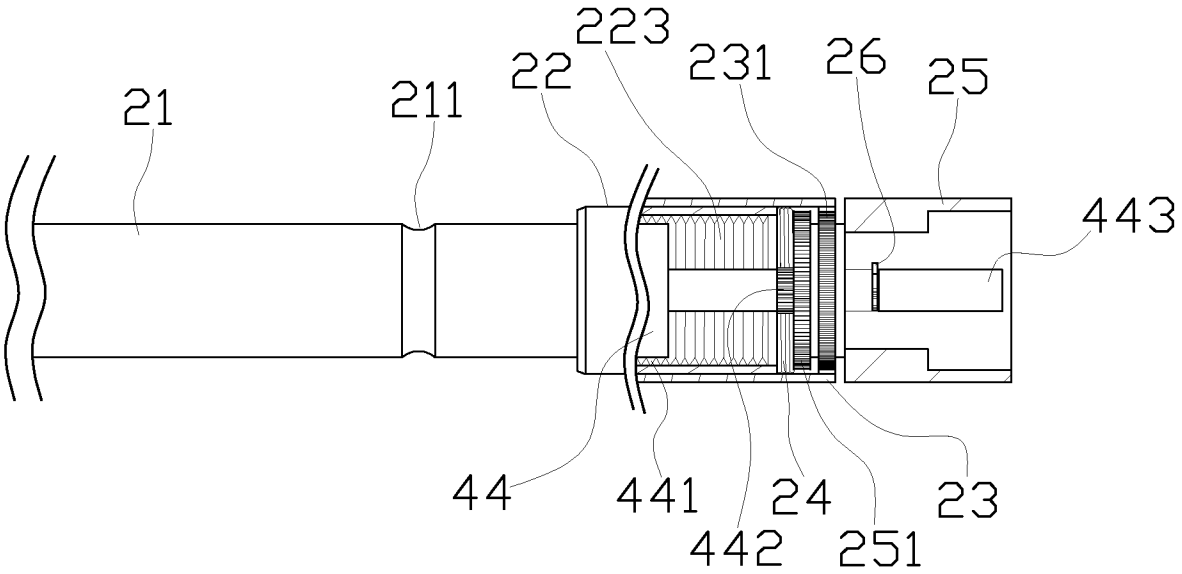
FIG. 7 is a perspective and partially sectional blowup view of the torque-setting secondary bar as depicted in FIG. 5 and situated at a position capable of adjusting a torque value.

With reference to FIGS. 6 and 7 for the method of adjusting and setting a torque value, since the handheld turning handle 23 has an inner ratchet ring 231 disposed at a position corresponsive to an inner periphery of the torque-adjusting screw cap 25, an outer ratchet ring 251 disposed at a corresponsive position of the torque-adjusting screw cap 25, and an inner ratchet hole 252 formed inside the torque-adjusting screw cap 25 and provided for a driving and rotating purpose, therefore the elastic pushing member 24 always pushes the torque-adjusting screw cap 25 outward, so that the inner and outer ratchet rings 231, 251 of the handheld turning handle 23 and the torque-adjusting screw cap 25 are engaged with each other. Now, the torque-adjusting screw cap 25 cannot be rotated anymore (as shown in FIG. 6). If the torque-adjusting screw cap 25 is pushed towards the handheld turning handle 23, the opposite inner and outer ratchet rings 231, 251 will be separated. Now, the inner ratchet hole 252 of torque-adjusting screw cap 25 is engaged with the ratchet 442 for driving the torque-adjusting column 443, so as to adjust the position of the sliding block 44 (as shown in FIG. 7) and achieve the effect of setting an expected torque value.

What is claimed is:

1. A detachable and torque-adjustable cross wrench, comprising:

a primary bar, with an end being a socket insertion end and the other end being installed with an assistant turning handle, and a center portion being a thickening middle section having a penetrating hole, a compression knob installed adjacent to the penetrating hole and provided for a snapping purpose, and an inner threaded hole formed at the bottom of the thickening middle section for locking a positioning bold therein, and slightly extending a front edge of the positioning bold into the penetrating hole; and a torque-setting secondary bar, comprising a plugging inner rod with a spacer ring slot, a force applying outer rod with a torque-setting module installed therein, a handheld turning handle, an elastic pushing member, a torque-adjusting screw cap and a retaining ring, wherein a pivoting end of the plugging inner rod has a pin hole, and a positioning slot formed at the bottom of the plugging inner rod and configured to be corresponsive to the positioning bold for inserting and pivotally coupling an insert pin and the force applying outer rod with the pin hole;

such that the aforementioned elements can be connected and combined with each other to form a cross wrench, and the torque-adjusting screw cap can be rotated to adjust and set the torque-setting module to a predetermined torque value, so as to achieve an expected torque-setting purpose.

2. The detachable and torque-adjustable cross wrench according to claim 1, wherein the torque-setting module is concealed in an axial inner hole of the force applying outer rod and sequentially comprises an ejecting block contacted with a pivoting end of the plugging inner rod, a powerful ejecting member, a sliding block having a scale, and a window disposed at the outer periphery of the force applying outer rod, and the sliding block has an external threaded portion screwed and connected with a corresponsive internal threaded portion of the force applying outer rod, and a torque-adjusting column disposed at an open end of the sliding block and having a ratchet provided for a driving purpose.

3. The detachable and torque-adjustable cross wrench according to claim 1, wherein the handheld turning handle includes an inner ratchet ring disposed at a position corresponsive to the inner periphery of the torque-adjusting screw cap, an outer ratchet ring disposed at a corresponsive position of the torque-adjusting screw cap, and an inner ratchet hole formed inside the handheld turning handle and provided for a driving and rotating purpose.

* * * * *